US010676871B2

(12) United States Patent
Dwiggins

(10) Patent No.: US 10,676,871 B2
(45) **Date of Patent: *Jun. 9, 2020**

(54) HIGH BULK TISSUE PRODUCT

(71) Applicant: GPCP IP Holdings LLC, Atlanta, GA (US)

(72) Inventor: John H. Dwiggins, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/899,013

(22) Filed: Feb. 19, 2018

(65) Prior Publication Data

US 2018/0266055 A1 Sep. 20, 2018

Related U.S. Application Data

(62) Division of application No. 14/699,690, filed on Apr. 29, 2015, now Pat. No. 9,915,034.

(60) Provisional application No. 61/994,325, filed on May 16, 2014, provisional application No. 62/108,243, filed on Jan. 27, 2015.

(51) Int. Cl.

| | |
|---|---|
| ***B31F 1/07*** | (2006.01) |
| ***D21H 27/42*** | (2006.01) |
| ***D21H 27/00*** | (2006.01) |
| ***D21H 27/40*** | (2006.01) |
| ***D21H 27/02*** | (2006.01) |
| ***A47K 10/16*** | (2006.01) |

(52) U.S. Cl.

CPC ..... *D21H 27/42* (2013.01); *A47K 10/16* (2013.01); *B31F 1/07* (2013.01); *D21H 27/007* (2013.01); *D21H 27/02* (2013.01); *D21H 27/40* (2013.01); *B31F 2201/0733* (2013.01); *B31F 2201/0761* (2013.01)

(58) Field of Classification Search

CPC ..... D21H 27/42

See application file for complete search history.

(56) References Cited

U.S. PATENT DOCUMENTS

| | | | |
|---|---|---|---|
| D37,898 | S | 3/1906 | Vandergaw |
| D52,204 | S | 7/1918 | Bunting |
| D88,847 | S | 1/1933 | Altman |
| D139,448 | S | 11/1944 | Christen |
| D139,966 | S | 1/1945 | Park |

(Continued)

FOREIGN PATENT DOCUMENTS

| | | |
|---|---|---|
| CA | 2436521 | 2/2002 |
| CN | 102529179 A | 7/2012 |

(Continued)

OTHER PUBLICATIONS

CanStockPhoto, Photo ID csp5756596, Mar. 5, 2011, retrieved from http://www.canstockphoto.es/metal-blanco-placa-c%3C3%ADrculos-5756596.html.

(Continued)

*Primary Examiner* — Jacob T Minskey

(74) *Attorney, Agent, or Firm* — Laura L. Bozek

(57) ABSTRACT

Products having improved caliper, sheet bulk and absorbency and methods for making those products are described. The method comprises producing a multi-ply product having different emboss patterns on each ply where the emboss patterns are made up of emboss elements having an aspect ratio of from about 1 to about 2.

7 Claims, 4 Drawing Sheets

(56) References Cited

U.S. PATENT DOCUMENTS

| | | | |
|---|---|---|---|
| D145,748 | S | 10/1946 | Park |
| D168,756 | S | 2/1953 | Odzer |
| D178,152 | S | 6/1956 | Schwartz |
| 3,819,452 | A | 6/1974 | Soehngen et al. |
| 4,339,088 | A | 7/1982 | Niedermeyer et al. |
| 4,376,671 | A | 3/1983 | Schulz |
| 4,493,868 | A | 1/1985 | Meitner et al. |
| 4,671,983 | A | 6/1987 | Burt et al. |
| D305,181 | S | 12/1989 | Veith et al. |
| D305,182 | S | 12/1989 | Peddada et al. |
| D322,173 | S | 12/1991 | Schultz et al. |
| D332,876 | S | 2/1993 | Shufelt et al. |
| 5,562,805 | A | 10/1996 | Kamps et al. |
| 5,693,403 | A | 12/1997 | Brown et al. |
| 5,834,099 | A | 11/1998 | Steinhardt et al. |
| D414,041 | S | 9/1999 | Dwiggins et al. |
| D419,779 | S | 2/2000 | Funk et al. |
| D421,341 | S | 3/2000 | Bak et al. |
| D440,050 | S | 4/2001 | Nicosia et al. |
| 6,245,414 | B1 | 6/2001 | Biagiotti |
| 6,251,207 | B1 | 6/2001 | Schultz et al. |
| 6,287,676 | B1 | 9/2001 | Ruppel et al. |
| 6,395,133 | B1 | 5/2002 | McNeil |
| D464,804 | S | 10/2002 | Brennan et al. |
| 6,681,826 | B1 | 1/2004 | Biagiotti |
| D488,931 | S | 4/2004 | Dwiggins et al. |
| D503,283 | S | 3/2005 | Boerschinger |
| 6,913,673 | B2 | 7/2005 | Baggot et al. |
| D522,251 | S | 6/2006 | Bierise et al. |
| D531,818 | S | 11/2006 | Hustedt et al. |
| D538,051 | S | 3/2007 | Kuehn et al. |
| D554,867 | S | 11/2007 | Bianchi |
| D570,607 | S | 6/2008 | Salaam et al. |
| D570,608 | S | 6/2008 | Salaam et al. |
| 7,384,506 | B2 | 6/2008 | Underhill et al. |
| 7,435,316 | B2 | 10/2008 | Boatman et al. |
| 7,494,564 | B2 | 2/2009 | Basler et al. |
| 7,771,566 | B2 | 8/2010 | Hilbig et al. |
| D624,756 | S | 10/2010 | Walther et al. |
| D626,217 | S | 10/2010 | Sealfon et al. |
| D646,804 | S | 10/2011 | Murakami et al. |
| 8,287,986 | B2 | 10/2012 | Huss et al. |
| D670,917 | S | 11/2012 | Blackford et al. |
| D672,563 | S | 12/2012 | Van et al. |
| D675,027 | S | 1/2013 | Olson et al. |
| D676,247 | S | 2/2013 | Olson et al. |
| D676,249 | S | 2/2013 | Olson et al. |
| D694,022 | S | 11/2013 | Olson et al. |
| D742,122 | S | 11/2015 | Hurley et al. |
| 9,382,663 | B2 | 7/2016 | Sze et al. |
| D782,830 | S | 4/2017 | Enderby |
| 2002/0155257 | A1 | 10/2002 | Schultz et al. |
| 2004/0191486 | A1 | 9/2004 | Underhill et al. |
| 2005/0079310 | A1 | 4/2005 | Germain et al. |
| 2005/0241788 | A1 | 11/2005 | Baggot et al. |
| 2006/0231224 | A1 | 10/2006 | Gelli et al. |
| 2009/0057951 | A1* | 3/2009 | Wegele ..... B31F 1/07 264/284 |
| 2009/0255640 | A1 | 10/2009 | Morin et al. |
| 2010/0030174 | A1 | 2/2010 | Buscher et al. |
| 2010/0297400 | A1* | 11/2010 | Mellin ..... D21H 27/02 428/167 |
| 2011/0081528 | A1 | 4/2011 | Shannon et al. |
| 2012/0244320 | A1 | 9/2012 | Sauter et al. |
| 2017/0022660 | A1 | 1/2017 | Suer et al. |

FOREIGN PATENT DOCUMENTS

| | | |
|---|---|---|
| MX | PA/2003/007330 | 2/2002 |
| WO | WO00/066740 | 2/2002 |

OTHER PUBLICATIONS

CanStockPhoto, Photo ID csp6566937, Jun. 13, 2011, retrieved from http://www.canstockphoto.es/blanco-tele-negro-puntos-lata-uso-plano-6566937.html.

CanStockPhoto, Photo ID csp10471744, Aug. 11, 2012, retrieved from http://www.canstockphoto.es/placa-metal-muchos-agujero-10471744.html.

International Preliminary Report on Patentability issued in corresponding Application No. PCT/US2015/029440, 13 pages.

International Preliminary Search Report and Written Opinion of the International Searching Authority that issued in International Application No. PCT//US2015/0294409 dated Aug. 7, 2015.

CMPC Tissue S.A. third-party submission dated Feb. 21, 2018, filed in MX/a/2016/014988, English translation.

"Dreamstime seamless pattern with hand drawn objects", found on Feb. 3, 2018 at: https://www.dreamstime.com/stock-illustration-seamless-pattern-hand-drawn-objects-sun-cloud-flowers-leaves-cocktail-butterfly-sketch-illustration-children-s-image70794690 date unknown.

* cited by examiner

HIGH BULK TISSUE PRODUCT

CROSS-REFERENCE TO RELATED APPLICATIONS

This application is a divisional of U.S. non-provisional patent application Ser. No. 14/699,690 filed Apr. 29, 2015, which claims benefit of both U.S. provisional application No. 62/108,242, filed Jan. 27, 2015 and U.S. provisional application No. 61/994,325 filed May 16, 2014.

The present disclosure relates to paper manufacturing an processing. In particular, the present disclosure relates to methods for improving the bulk and absorbency of fibrous webs. More particularly, the present disclosure relates to an embossing pattern that improves the bulk and absorbency of fibrous webs. Further, the present disclosure relates to a conventional wet press tissue bearing an emboss pattern as described in the instant disclosure. Still further, the present disclosure relates to a multi-ply tissue product having improved bulk and absorbency.

In a conventional wet press process, a furnish of pulp, water, and other chemicals, is fed to a headbox from which it is deposited on a forming wire. The nascent web is transferred to a papermaking felt and is dewatered by passing it between the felt and a press roll under pressure. The web is then pressed by a suction press roll against the surface of a rotating Yankee dryer cylinder that is heated to cause the paper to substantially dry on the cylinder surface. The moisture within the web as it is laid on the Yankee surface causes the web to transfer to the surface. Liquid adhesive may be applied to the surface of the dryer, as necessary, to provide substantial adherence of the web to the surface. The web is then removed from the Yankee surface with a creping blade. The creped web is then passed between calender milers and rolled up to be used as a base sheet in the downstream production of a tissue product. This method of making tissue sheets is commonly referred to as "wet-pressed" because of the compactive method used to dewater the wet web.

As used in the present disclosure "wet press," "wet-pressed," "wet-pressing," "conventional wet press," "CWP" and other variations on those phrases refer to processes by which a base sheet can be produced. These processes all share the characteristic that the sheet is dewatered under pressure. While one conventional wet pressing operation is described above, the system is only exemplary and variations on the described system will be readily apparent to the skilled artisan.

Conventional wet pressed tissue exhibits an increased density and lower bulk due to compression during the dewatering process. The action of the creping blade on the paper web is known to cause a portion of the interfiber bonds within the paper to be broken up by the mechanical smashing action of the blade against the web as it is being driven into the blade. Even after creping, which attempts to return sheet bulk, wet pressed webs generally retain a diminished bulk and water absorbency.

As an alternative to conventional wet press technology, through-air-drying ("TAD") methods have been developed in which the nascent web is partially dewatered using vacuum suction. Thereafter, the partially dewatered web is dried without compression by passing hot air through the web while it is supported by a through-dying fabric. However, as compared to conventional wet pressing through-air-drying is expensive in terms of capital and energy costs. Because of the consumer perceived softness of these products, and their greater ability to absorb liquid than webs formed in conventional wet press processes, the products formed by the through-air-drying process enjoy an advantage in consumer acceptance.

Because it does not suffer from compaction losses, through-air-dried tissue base sheets currently exhibits the highest caliper, i.e., bulk of any base sheet for use in premium tissue product. Because of the high energy demands of TAD, other structured tissue technologies have been developed. These technologies all use special fabrics or belts to impart a structure to the sheet but use significantly lower nip loads for dewatering than conventional wet pressing. These processes, like TAD, have a higher energy consumption than conventional wet pressing. As used herein "structured tissues" or "structured webs" refers to tissue that is produced with one of these newer methods.

The present disclosure provides an embossed tissue sheet having improved caliper, bulk and absorbency. According to one embodiment, the embossing method of the present invention can be used to increase the bulk of tissue sheets made using conventional wet pressing to the levels ordinarily found in through-air-dried webs. While the method of this invention is described in terms of conventional wet pressed base sheets, the method and embossing design of the present disclosure can be used to improve the bulk of through-air dried webs or other structured webs currently used in premium products.

As used herein "web," "sheet," "tissue," "nascent web," "tissue product" "base sheet" or "tissue sheet," can be used interchangeably to refer to the fibrous web during various stages of its development. Nascent web, for example, refers to the embryonic web that is deposited on the forming wire. Once the web achieves about 30% solids content, it is referred to as a tissue, or a sheet or a web. Post production, the single-ply of tissue is called a base sheet. The base sheet may be used alone or combined with other base sheets to form a tissue product or a multi-ply product.

SUMMARY OF THE DISCLOSURE

The present disclosure relates to a soft tissue product produced with an emboss pattern described in the instant disclosure. These higher bulk base sheets allow the final tissue products to be produced using less fiber material resulting in a conservation of resources. Further when applying the embossing pattern to a conventional wet press base sheet there are considerable energy savings.

In one embodiment, the present disclosure relates to a tissue product comprising at least two tissue plies, wherein the back-most ply is embossed with an emboss pattern that is a regular and continuous pattern and that comprises emboss elements having an aspect ratio from about 1 to about 2, and a size of from about 0.015 to about 0.070 inches; wherein the top-most ply is embossed with a decorative pattern that comprises decorative elements made up of discrete emboss elements having an aspect ratio from about 1 to about 2, and a size of from about 0.015 to about 0.070 inches; wherein adhesive is applied to the tops of the emboss elements of the decorative pattern on the top-most ply, and the plies are bonded.

According to another embodiment, the disclosure relates to a multi-ply paper product comprising at least two tissue plies produced by conventional wet pressing wherein the back-most ply is embossed with an emboss pattern that comprises emboss elements having an aspect ratio from about 1 to about 2, and a size of from about 0.0154 to about 0.070 inches and a density of from about 30 elements/in to about 380 elements/in; wherein the top-most ply is embossed with a decorative pattern that comprises decorative elements made up of discrete emboss elements having an aspect ratio from about 1 to about 2 and wherein the decorative pattern exhibits a bond area across the cross-machine direction (CD) of a repeat cell and a bond area across the machine direction (MD) of the same repeat cell each ranging from about 5% to about 20%; and wherein adhesive is applied to the tops of the emboss elements of the decorative pattern on the top-most ply, and the plies are bonded.

According to yet another embodiment, the instant disclosure relates to a method of making a multi-ply product comprising, obtaining at least two base sheets, embossing the first base sheet with a series of amplifying emboss elements that improve the caliper of the base sheet by at least about 30%; embossing the second base sheet with a decorative pattern comprising discrete embossing elements; plying the first and second base sheets by applying adhesive to the second base sheet and combining the at least two plies into a multi-ply product.

Additional advantages of the described methods and products will be set forth in part in the description which follows, and in part will be, obvious from the description, or may be learned by practice of the disclosure. The advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed. The accompanying drawings, which are incorporated in and constitute a part of this specification, illustrate several embodiments and together with the description, serve to explain the principles of the disclosure.

DESCRIPTION

Figure 1A:
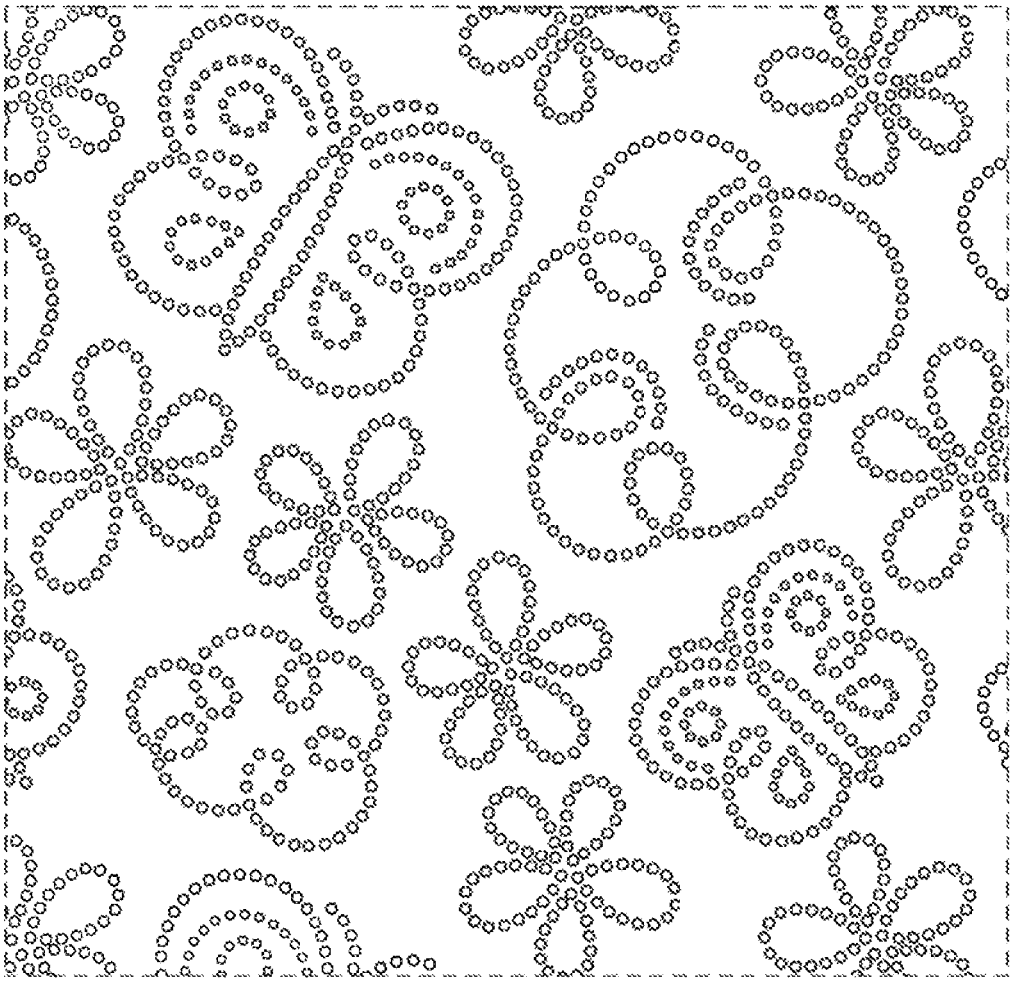
FIGS. 1A and 1B illustrate emboss patterns for use on the top-most ply of a multi-ply product according to the disclosure.

Reference will now be made in detail to certain exemplary embodiments, examples of which are illustrated in the accompanying drawings. Wherever possible, the same reference numbers will be used throughout the drawings to refer to the same or like items.

The present disclosure relates to a bulky, soft and absorbent tissue product. The methods as described can be used to produce multi-ply products including toilet tissue, paper towels, napkins, facial tissue, wipers, and other consumer tissue products desiring an aesthetic look and improved bulk. The embossing method as disclosed can be applied to any non-woven product, natural or synthetic, where increased bulk is desired.

The base sheet for use in the products of the present disclosure may be made from any art recognized fibers. Papermaking fibers used to form the absorbent products of the present disclosure include cellulosic fibers, commonly referred to as wood fibers. Specifically, the base sheet of the disclosure can be produced from hardwood (angiosperms or deciduous trees) or softwood (gymnosperms or coniferous trees) fibers, and any combination thereof. Hardwood fibers include, but are not limited to maple, birch, aspen and eucalyptus. Hardwood fibers generally have a fiber length of about 2.0 mm or less. Softwood fiber includes spruce and pine and exhibit an average fiber length of about 2.5 mm. Cellulosic fibers from diverse material origins may also be used to form the web of the present disclosure. The web of the present disclosure may also include recycle or secondary fiber. The products of the present disclosure can also include synthetic fibers as desired for the end product.

Papermaking fibers can be liberated from their source material by any one of the number of chemical pulping processes familiar to one experienced in the art including sulfate, sulfite, polysulfite, soda pulping, etc. The pulp can be bleached as desired by chemical means including the use of chlorine, chlorine dioxide, oxygen, etc. Alternatively, the papermaking fibers can, be liberated from source material by any one of a number of mechanical/chemical pulping processes familiar to anyone experienced in the art including mechanical pulping, thermomechanical pulping, and chemi-thermomechanical pulping. These mechanical pulps can be bleached, if one wishes, by a number of familiar bleaching schemes including alkaline peroxide and ozone bleaching.

The fiber is fed into a headbox where it will be admixed with water and chemical additives, as appropriate, before being deposited on the forming wire. The chemical additives for use in the formation of the base sheets can be any known combination of papermaking chemicals. Such chemistry is readily understood by the skilled artisan and its selection will depend upon the type of end product that one is making. Papermaking chemicals include, for example, strength agents, softeners and debonders, creping modifiers, sizing agents, optical brightening agents, retention agents, and the like. The method used in the instant invention to increase sheet bulk should not generally be affected by the chemistry of the base sheet.

A first nascent web is formed from the pulp. The web can be formed using any of the standard wet-press configurations known to the skilled artisan, e.g., crescent former, suction breast roll, twin-wire former, etc. Once the web is formed, it preferably has a basis weight, under TAPPI LAB CONDITIONS of at least about 9 lbs/3000 sq. ft. ream, preferably at least about 10 lbs/3000 sq. ft. ream, more preferably at least about 11-14 lbs/3000 sq. ft. ream. TAPPI LAB-CONDITIONS refers to TAPPI T-402 test methods specifying time, temperature and humidity conditions for a sequence of conditioning steps.

The web is transferred from the forming wire to a felt or fabric for compactive dewatering. Finally, the web is adhered to a Yankee dryer. The web can be adhered to the Yankee dryer using any known creping adhesive.

The web is then creped from the Yankee dryer. The relative speeds between the Yankee dryer and the reel are preferably controlled to such a level that a reel crepe of at least about 20%, more preferably 24% and most preferably 25% is maintained. Percent crepe is defined as the Yankee dryer speed minus the reel speed, divided by the Yankee dryer speed, expressed as a percentage. Creping is preferably carried out at a creping angle of from about 70° to about 88°, preferably about 73° to about 85° and more preferably about 80°.

The web is then calendered and rolled to await converting. Converting refers to the processes that change or convert a base sheet into a final product. Typical converting in the area of tissue and towel includes embossing, perforating, and plying.

While exemplary formation of the base sheet is detailed above, products using any base sheet can benefit from the improved bulk and absorbency associated with the disclosed invention. The base sheet for use in the present disclosure can be produced by CWP, TAD or other structured tissue formation methods and can include base sheets that are creped or uncreped, homogeneous or stratified, wet-laid or air-laid and may contain up to 100% non-cellulose fibers.

The products of the present disclosure are embossed. The typical tissue embossing process involves the compression and stretching of the flat tissue base sheet between a relatively soft rubber roll and a hard roll which bears a pattern of emboss elements. This method of embossing improves the aesthetics of the tissue, and the structure of the tissue roll. However, the thickness of the base sheet between the emboss elements is actually reduced, further lowering the perceived bulk of a CWP product made by this process. According to one embodiment, the base sheets of the present disclosure can be embossed in this rigid-resilient fashion.

In the process of the present disclosure, the base sheets can also be embossed between two hard rolls each of which contain both male and female elements. The elements of one emboss roll are engaged or mated with the female elements of another mirror image emboss oil. These emboss rolls can be made of materials such as steel or hard rubber. In this process, the base sheet is only compressed between the sidewalls of the male and female elements. Therefore, base sheet thickness is better preserved and bulk perception of a product is much improved. This mated process and pattern also creates a softer tissue because the top of the tissue protrusions remain soft and uncompressed. According to one embodiment, the base sheets of the present disclosure can be embossed in a rigid-rigid fashion.

The multiply tissue product of the invention will be described with reference to the various plies. As used in the present disclosure "topmost," "top ply," front "front-most," are interchangeable and refer to the exposed ply of a tissue ribbon that will bear an aesthetic design and form the top of the final tissue product. The phrases "back-most," "back," "bottom-ply," "bottom-most" are interchangeable and refer to the exposed ply on the reverse of the final tissue product. "Intermediate-ply(s)" or "center-ply(s)" are interchangeable and refer to any base sheets that form a third or fourth ply between the top and bottom plies.

The multi-ply products of the present disclosure have a pattern on the topmost sheet that is aesthetic and which improves the bulk and softness of the product. The pattern on the topmost ply bears a pattern that covers from about 3 to about 25 of the tissue. The pattern on the topmost ply may include any aesthetic pattern or design, so long as the design is substantially made up of individual discrete elements that form larger decorative items in the aesthetic pattern. While the structure of the embossments is an aspect of the invention, the aesthetic pattern can take any shape or form. These aesthetic designs can take the form of trademarks or trade dress and thereby associate the particular manufacturer of the tissue with the product.

According to one embodiment, the topmost pattern is used to hold adhesive that will be used to bond the plies. In this embodiment, the tips of the individual emboss elements that make up the larger pattern carry adhesive. Such an arrangement allows excellent ply bonding without a significant increase in stiffness caused by too much adhesive. The inclusion of larger emboss elements or linear elements in the pattern of the topmost ply impacts various properties, including stiffness. Linear elements will increase the surface area that holds adhesive and will cause a loss in softness. To the extent that a reduction in softness is acceptable, the present invention contemplates that the aesthetic pattern could contain some limited linear embossing elements.

The paper products according to the present invention can be plied using any art recognized method, including but not limited to, mechanical lamination, for example, by knurling or embossing and chemical means, including but not limited to a chemical adhesive. Any art recognized adhesive may be used in the invention of the instant disclosure.

According to one embodiment, the emboss pattern used on the topmost ply exhibits a bond area across the cross-machine direction (CD) of a repeat cell and a bond area across the machine direction (MD) of the same repeat cell each ranging from about 5% to about 20 As defined herein, the bond area is calculated by measuring the bond area of the emboss pattern across the entire CD or MD of the repeat unit. The bond area is measured on a linear basis across the repeat unit. The bond area as defined herein is calculated based upon either the embossing roll used to produce the embossed sheet or the engineering drawings used to produce the emboss roll. The bond area, of the emboss patterns for use in the present invention range between about 5% and about 20%.

Figure 1B:
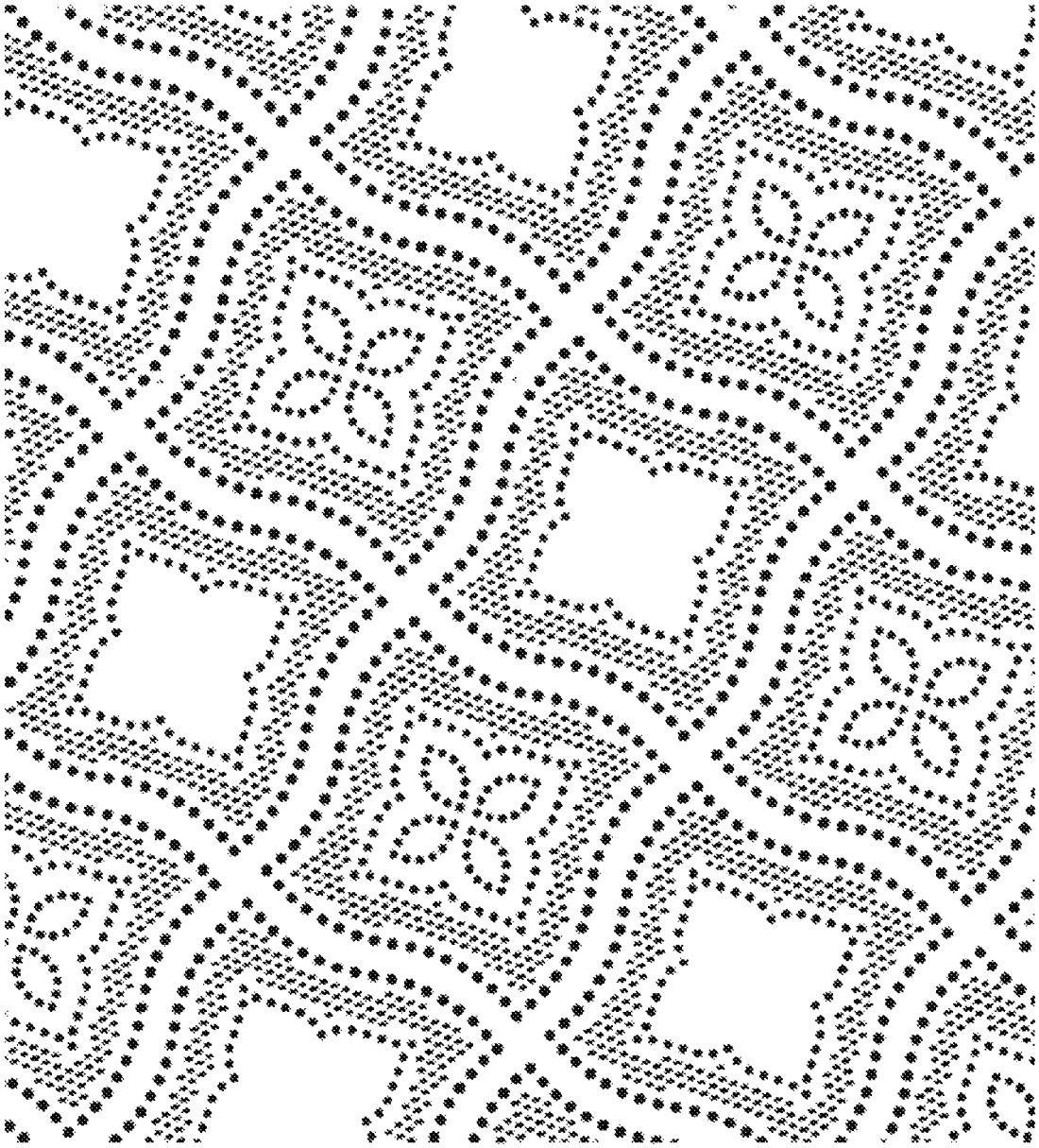

FIGS. 1A and 1B depict repeating patterns for use in the products of the present disclosure. For rolled products, the pattern would generally traverse the entire width and length of the base sheet. The pattern contains larger decorative elements, i.e., a butterfly, a cloud or a flower, that are made up of a series of smaller embossing elements. As used herein, these smaller embossing elements that make up the decorative pattern will be referred to as "discrete" embossing elements or "individual" embossing elements, both terms being used interchangeably to define the embossments that are used to make up the decorative elements. These discrete embossing elements can be homogeneous in size or can vary within the pattern. The patterns as shown in FIGS. 1A and 1B, contain elements of varying size. In addition, the shape of the elements can be varied within a given pattern.

According to one embodiment, discrete embossing elements have an aspect ratio of 1. Examples of elements having this aspect ratio, include for example circles and squares. According to this embodiment of the present disclosure, the discrete embossing elements can have an aspect ratio of from 1 to about 1.25, for example from about 1 to about 1.1.

According to one embodiment, when discrete embossing elements have an ovoid shape, the aspect ratio can be from about 1 to about 2.

According to one embodiment, the discrete embossing elements have a size of from between about 0.015 inches and about 0.070 inches, for example, between about 0.05 inches to about 0.07 inches, for example, between about 0.03 inches and about 0.04 inches, for example between about 0.045 inches and about 0.055 inches. As used herein, "size" refers to the measurement of the shortest dimension of the discrete embossing element.

According to another embodiment, the angle of the sidewalls of the elements is between about 10 and about 30 degrees, for example, between about 19 and 23 degrees, for example, about 20 degrees. According to yet another embodiment, the discrete embossing elements are embossed to a depth of from 0.050 to about 0.080 inches, for example, to a depth of about 0.60 to about 0.70 inches. The size of the emboss elements are measured in the center of the radius. As used herein size refers to the average of the elements.

According to one embodiment, as shown in FIG. 1A, the pattern contains discrete embossing elements having a size of about 0.050 inches, along with discrete embossing elements having a size of about 0.040 inches, as well as discrete embossing elements that have a size of 0.045 inches. In this example, the decorative elements are made up solely of curvilinear segments.

The multi-ply products of the present disclosure have a pattern on the bottommost sheet that is less decorative but which substantially improves the bulk, absorbency and softness of the product. The bottommost ply bears a pattern that covers between about 10% and between about 25% of the tissue surface. The density of the emboss elements on the bottommost sheet can be varied within the disclosed ranges, as long as the bulk and softness characteristics are maintained. The shape of the embossing elements in the bottommost pattern can be altered, for example to be square, but the aspect ratio of the elements should remain close to 1.

Figure 2:
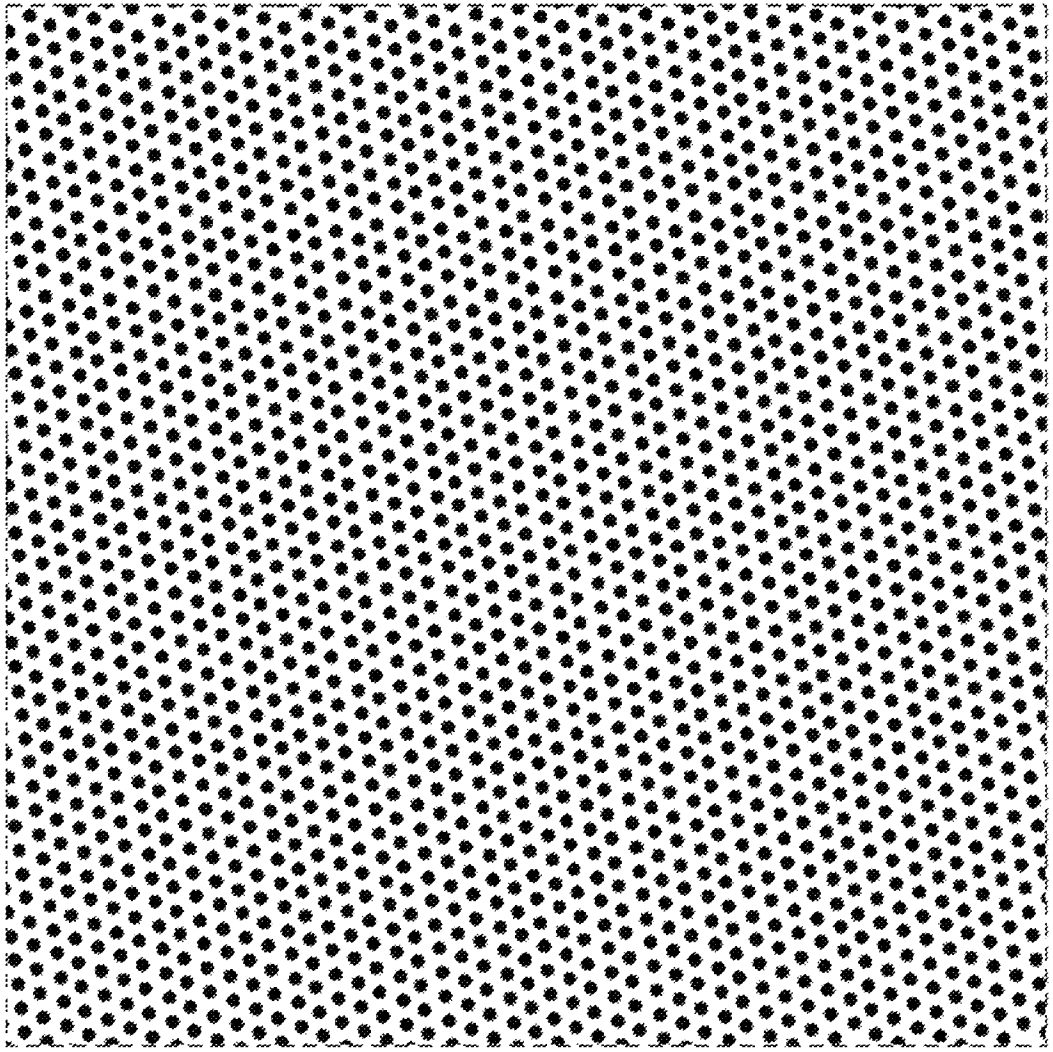
FIG. 2 illustrates an emboss pattern for use on the bottom-most ply of a multi-ply product according to the disclosure.

FIG. 2 depicts one repeating pattern for use in the products of the present disclosure. For rolled products, the pattern would generally traverse the entire width and length of the base sheet. The pattern contains a continuous and regular pattern of embossments that cause the bulk of the sheet to increase. As used herein, these embossing elements that are on the bottommost ply of the product will be referred to as "amplifying embossments." These amplifying embossing elements can be homogeneous in size and shape or can vary within a given pattern. The pattern as shown in FIG. 2, contains elements of a single size.

According to one embodiment, amplifying embossing elements, like the discrete elements of the topmost pattern also have an aspect ratio of about 1. Examples of elements having this aspect ratio, include for example circles and squares. According to one embodiment of the present disclosure, the amplifying embossing elements can have an aspect ratio of from 1 to about 1.25, for example from about 1 to about 1.1.

According to one embodiment, when the amplifying embossing elements have an ovoid shape, the aspect ratio can be from about 1 to about 2.

According to one embodiment, the amplifying embossing elements have a size of from between about 0.005 inches and about 0.070 inches, for example, between from about 0.015 inches to about 0.07 inches, for example, between about 0.03 inches and about 0.04 inches, for example between about 0.045 inches and about 0.055 inches. As used herein, "size" refers to the measurement of the shortest dimension of the amplifying element.

According to another embodiment, the angle of the sidewalls of the amplifying elements is between about 10 and about 30 degrees, for example, between about 19 and 23 degrees, for example, about 20 degrees. According to yet another embodiment, the amplifying embossing elements are embossed to a depth of from 0.050 to about 0.080 inches, for example, to a depth of about 0.60 to about 0.70 inches.

According to one embodiment, the average density of the amplifying embossing elements is from about 30 to 380 emboss elements/in, for example, from 50 to about 250 emboss elements/in, for example, from about 70 to about 150 embossments/in, for example, from about 70 to about 105 embossments/in. According to one embodiment, when the height of the emboss elements is reduced, a concurrent increase in the element density will be seen.

According to one embodiment, the pattern of amplifying elements can be oriented so that the tops of the amplifying elements protrude from the sheet and form the exposed surface of the paper product or they can be oriented inward so that they are on the bonding side of the base sheet.

According to one embodiment, as shown in FIG. 2, the pattern contains amplifying embossing elements having a width of about 0.050 inches, and an average density 105 embossing elements/in. The pattern of amplifying embossing elements shown in FIG. 2 is oriented so that the elements extend outward.

Unless otherwise specified, "basis weight", BWT, BW, and so forth, refers to the weight of a 3000 square-foot ream of product (basis weight is also expressed in g/m$^2$ or gsm). Likewise, "ream" means a 3000 square-foot ream, unless otherwise specified. The multi-ply product of the present disclosure has a basis weight of from about 19 to about 28 lbs/ream, for example, from about 20 to about 26 lbs/ream, for example, from about 22 to about 24 lbs/ream.

The multi-ply product of the present disclosure has a caliper of from at least about 125 to about 200 mils/8 sheets, for example, from about 125 to about 175 mils/8 sheets, for example, from about 130 to about 180 mils/8 sheets, for example, from about 150 to about 180 mils/8 sheets, for example, from about 130 to about 150 mils/8 sheets.

Calipers reported herein are 8-sheet calipers unless otherwise indicated. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For furnished product testing, each sheet of product to be tested must have the same number of plies as the product is sold. For base sheet testing off of the paper machine reel, single plies are used with eight sheets being selected and stacked together. Specific volume is determined from basis weight and caliper.

The multi-ply product of the present disclosure has a geometric Mean Tensile Strength of from about 500 to about 1100, for example, from about 600 to about 900, for example, from about 650 to about 750.

Dry tensile strengths (MD and CD), stretch, ratios thereof, break modulus, stress and strain are measured with a standard Instron test device or other suitable elongation tensile tester which may be configured in various ways, typically using 3 or 1 inch wide strips of tissue or towel, conditioned at 50% relative humidity and 23° C. (73.4° F.), with the tensile test run at a crosshead speed of 2 in/min for modulus, 10 in/min for tensile. For purposes of calculating modulus values, inch wide specimens were pulled at 0.5 inches per minute so that a larger number of data points were available. Unless otherwise clear from the context stretch refers to stretch (elongation) at break. Break modulus is the ratio of peak load to stretch at peak load. Tensile modulus, reported in grams per inch per percent strain, is determined by the same procedure used for tensile strength except that the modulus recorded is the geometric mean of the chord slopes of the cross direction and machine direction load-strain curves from a value of 0 to 100 grams, and a sample width of only one inch is used.

GMT refers to the geometric mean tensile strength of the CD and MD tensile. Tensile energy absorption (TEA) is measured in accordance with TAPPI test method T494 om-01.

The multi-ply product of the present disclosure has a roll compression of from about 10% to about 30%, for example, from about 12% to about 25%, for example, from about 16% to about 20%.

The multi-ply product of the present disclosure has a TMI ply bond of at least about 2 g, for example, from about 2 g to about 20 g, for example, from about 5 g to about 15 g.

Ply bond strengths reported herein are determined from the average load required to separate the plies of two-ply tissue, towel, napkin, and facial finished products using TMI Ply Bond Lab Master Slip & Friction tester Model 32-90, with high-sensitivity load measuring option and custom planar top without elevator available from: Testing Machines Inc. 2910 Expressway Drive South Islandia, N.Y. 11722; (800)-678-3221; www.testingmachines.com. Ply Bond clamps are available from: Research Dimensions, 1720 Oakridge Road, Neenah, Wis. 54956, Contact: Glen Winkler, Phone: 920-722-2289 and Fax: 920-725-6874.

Samples are preconditioned according to TAPPI standards and handled only by the edges and corners care being exercised to minimize touching the area of the sample to be tested.

At least ten sheets following the tail seal are discarded. Four samples are cut from the roll thereafter, each having a length equivalent to 2 sheets but the cuts are made ¼" away from the perforation lines by making a first CD cut ¼" before a first perforation and, a second CD cut ¼" before the third, perforation so that the second perforation remains roughly centered in the sheet. The plies of each specimen are initially separated in the leading edge area before the first perforation continuing to approximately 1 inch past this perforation.

The sample is positioned so that the interior ply faces upwardly, the separated portion of the ply is folded back to a location ½" from the initial cut and ¼" from the first perforation, and creased there. The folded back portion of the top ply is secured in one clamp so that the line contact of the top grip is on the perforation; and the clamp is placed back onto the load cell. The exterior ply of the samples is secured to the platform, aligning the perforation with the line contact of the grip and centering it with the clamp edges.

After ensuring that the sample is aligned with the clamps and perforations, the load-measuring arm is slowly moved to the left at a speed of 25.4 cm/min, for a test length of 16.5 cm and the average load between 5-14 cm on the arm (in g.) is measured and recorded. The average of 3 samples is recorded with the fourth sample being reserved for use in case of damage to one of the first three.

For products having more than two plies follow the same preparation procedure and obtain two samples. Take one sample and test each of the plies starting with the outside ply and removing one sheet at a time until all plies are tested. Each of the individual ply bonds are averaged to obtain the ply bond value in grams. Test the other sample the same way and the average of the two in grams is reported.

According to one embodiment, the multi-ply product of the present disclosure has a saturation capacity of from about 1500 to about 1900 g/m$^2$, for example, from about 1700 to about 1800 g/m$^2$, for example, from about 1750 to about 1800 g/m$^2$. The multi-ply product according to one embodiment of the present disclosure exhibits a saturation ratio of from about 70 to about 90, for example, from about 75 to about 85 g/m$^2$/lb/3000 ft$^2$. As used herein saturation ratio refers to saturation capacity divided by of basis weight.

Absorbency of the inventive products is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top plastic cover and a bottom grooved sample plate. The tissue sample disc (5 sheets thick) is held in place by a inch wide circumference flange area. The sample is not compressed by the holder. De-ionzed water at 73° F. is introduced to the sample at the center of the bottom sample plate through a 3 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibition decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC, or water absorbent capacity, also referred to as SAT, is actually determined by the instrument itself. WAC is defined as the point where the weight versus time graph reaches the termination criteria. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow SAT" is specified in which case the cut off criteria is 1 mg in 25 seconds.

Water absorbency rate is measured in seconds and is the time it takes for a sample to absorb a 0.1 gram droplet of water disposed on its surface by way of an automated syringe. The test specimens are preferably conditioned at 23° C.±1° C. (73.4° F.±1.8° F.) at 50% relative humidity. For each sample, 4 3×3 inch test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample, SAT Rate is determined by graphing the weight of water absorbed by the sample (in grams) against the square root of time (in seconds). The SAT rate is the best fit slope between 10 and 60 percent of the end point (grams of water absorbed).

The multi-ply product of the present disclosure has a sensory softness of from about 17 to about 20, for example, from about 17.5 to about 9, for example, from about 18.0 to about 18.5.

Subjective product attributes, such as sensory softness, are often best evaluated using test protocols in which a consumer uses and evaluates a product. In a "monadic" test, a consumer will use a single product and evaluate its characteristics using a standard scale. In paired comparison tests, the consumers are given samples of two different products and asked to rate each vis-à-vis the other for either specific attributes or overall preference. Sensory softness is a subjectively measured tactile property that approximates consumer perception of sheet softness in normal use. Softness is usually measured by 20 trained panelists and includes internal comparison among product samples. The results obtained are statistically converted to a useful comparative scale.

The multi-ply product of the present disclosure has a bulk of at least about 5.9 (caliper/BW)/mils/8 plies/lb/ream from about 6.0 to about 7.5 (caliper/BW/mils/8 plies/lb/ream, for example, from about 6.5 to about 7.2 (caliper/BW)/mils/8 plies/lb/ream. Bulk is calculated from the caliper and basis weight measurements as described above.

It should be noted that the methods and products described herein should not be limited to the examples provided. Rather, the examples are only representative in nature.

Example 1

Figure 3:
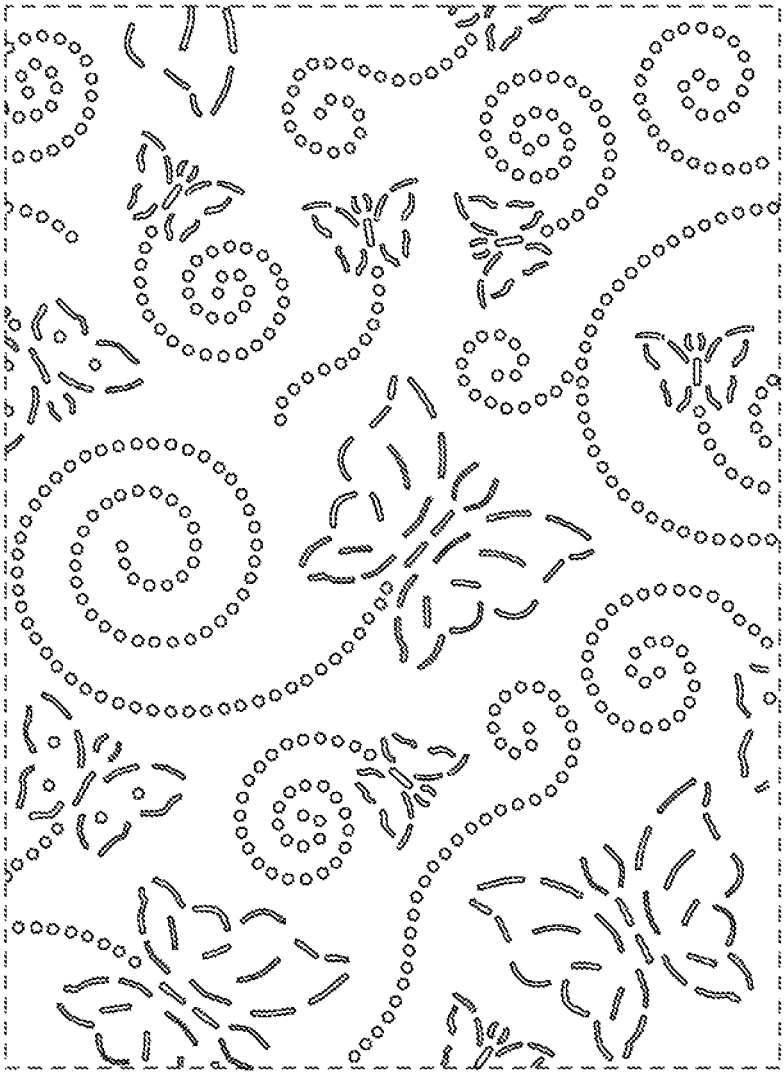
FIG. 3 illustrates an emboss pattern currently used on a commercial multi-ply product.

Two ply paper products were produced using base sheets made at commercial paper mills. The comparative product was embossed with the pattern as shown in FIG. 3. Two-ply products of the same base sheet were embossed according to the instant invention with the patterns of FIG. 1A on the top ply and FIG. 2 on the bottom ply.

As can be seen from Table 1, below, two-ply products according to the present invention exhibited significant improvements in bulk and absorbency while maintaining a soft sheet.

When comparing the inventive product against the conventionally embossed product on the first base sheet, the caliper of the inventive product exhibited a 30% improvement. Likewise, when comparing the inventive product again the conventionally embossed product on the second base sheet and third base sheet, the caliper of the inventive product went up by 41% and 37%, respectively. Finally, when comparing the inventive product against the conventionally embossed product on the fourth base sheet, the caliper improved by an outstanding 81%.

The paper product according to the instant disclosure exhibits an improvement in caliper of from about 30% to about 85%, for example, from about 30% to about 50%, for example from about 30% to about 40%. As used herein, percent increase in caliper is defined as an increase in the caliper of a base sheet when embossed with a pattern in accordance with the invention compared to the same base sheet bearing the pattern of FIG. 3.

As can be seen from Table 1, the product produced in accordance with the present disclosure also exhibits an improvement in SAT Capacity, i.e., absorbency. The absorbency of the products of the present invention improved by more than 100 g/m$^2$, for example, base sheet one improved 245 g/m$^2$, while using base sheet two, the product improved by 139 g/m$^2$ and finally using base sheet three, the product improved by 159 g/m$^2$.

Finally, each of the products of the present invention exhibit significant improvements in bulk. As can be seen from Table 1, the product made from base sheet four increased in bulk from 4.08 to 7.49 (caliper/basis weight)/mils/8 plies/lb/R. This product according to the present invention provides a bulk which is a significant improvement over the commercial TAD product marketed as Great Value Ultra Strong.

The products contemplated by of the present disclosure have characteristics of bulk and absorbency that rival current TAD market products, but they can be produced using far less energy if the base sheet is a conventional wet press base sheet.

Additionally, other embodiments will be apparent from consideration of the specification and practice of the present disclosure. It is intended that the specification and examples be considered as exemplary only, with a true scope and spirit of the invention being indicated by the following claims.

What is claimed is:

1. A tissue product comprising, at least two tissue plies, wherein the back-most ply is embossed with an emboss pattern that is a regular and continuous pattern and that comprises emboss elements having an aspect ratio of from about 1 to about 2, and a size of from about 0.015 to about 0.070 inches;

wherein the top-most ply is embossed with a decorative pattern that comprises decorative elements made up of

TABLE 1

| Product IDs and converting process | FIG. 3 Emboss Base 1 | Invention Base 1 | FIG. 3 Emboss Base 2 | Invention Base 2 | FIG. 3 emboss Base 3 | Invention Base 3 | FIG. 3 emboss Base 4 | Invention Base 4 | Market Great Value Ultra Strong TAD |
|---|---|---|---|---|---|---|---|---|---|
| Sheet Count | 264 | 300 | 319 | 300 | 264 | 260 | 264 | 150 | |
| Basis Weight (lbs/ream) | 23.5 | 22.5 | 20.4 | 19.9 | 27.4 | 26.0 | 24.0 | 23.7 | 23.5 |
| Caliper (mils/8shts) | 102 | 133 | 92 | 129 | 112 | 153 | 98 | 178 | 145 |
| Geometric Mean Tensile (g/3") | 549 | 561 | 705 | 584 | 553 | 527 | 718 | 696 | 1116 |
| Roll Diameter (inches) | 4.68 | 5.97 | 4.59 | 5.45 | 4.91 | 5.82 | 4.65 | 4.83 | 4.68 |
| Roll Compression (%) | 18.6 | 24.0 | 13.6 | 14.8 | 18.6 | 23.9 | | 24.1 | 28.1 |
| TMI Ply Bond (g) | 0.0 | 6.9 | 0.0 | 9.9 | 0.0 | 8.3 | 0.0 | 8.7 | 16.5 |
| SAT Capacity g/m$^2$ (5 sheets) | 1486 | 1731 | 1502 | 1641 | 1637 | 1796 | | 1743 | 1774 |
| SAT Rate g/s^0.5 | 0.27 | 0.30 | 0.38 | 0.41 | 0.32 | 0.35 | | 0.38 | 0.57 |
| SAT Time sec Vokl volume | 265.7 | 302.8 | 160.9 | 129.3 | 205.0 | 224.2 | | 181.8 | 141.2 |
| Sensory Softness | 18.2 | 18.2 | 17.0 | 17.7 | 18.2 | 18.2 | −17.4 | 17.4 | 19.3 |
| Bulk (caliper/basis weight) mils/8 plies/lb/R | 4.34 | 5.91 | 4.49 | 6.49 | 4.09 | 5.88 | 4.08 | 7.49 | 6.19 |
| Saturation Ratio g/m$^2$ (5 sheets)/ lbs/3000 ft$^2$ | 63 | 77 | 74 | 82 | 84 | 89 | — | 73 | 76 |

discrete emboss elements having an aspect ratio of from about 1 to about 2, and a size of from about 0.015 to about 0.070 inches.

2. The tissue product of claim 1, wherein the back-most ply is produced using conventional wet pressing.

3. The tissue product of claim 2, wherein the top-most ply is produced using conventional wet pressing.

4. The tissue product of claim 1, wherein adhesive is applied to the tops of the emboss elements of the decorative pattern on the top-most ply, and the plies are bonded.

5. The tissue product of claim 2, wherein the top-most ply is produced using through-air-drying or another method for forming a structured base sheet.

6. The tissue product of claim 1, wherein the density of the emboss elements on the back-most ply are from about 30 to about 150 embossments per square inch.

7. The tissue product of claim 1, wherein the decorative pattern exhibits a bond area across the cross-machine direction (CD) of a repeat cell and a bond area across the machine direction (MD) of the same repeat cell each ranging from about 5% to about 20%.

* * * * *